US005353561A

United States Patent [19]

Menchetti

[11] Patent Number: 5,353,561

[45] Date of Patent: Oct. 11, 1994

[54] AREA SEPARATION WALL AND STUD THEREFOR

[75] Inventor: Robert J. Menchetti, Buffalo, N.Y.

[73] Assignee: National Gypsum Company, Charlotte, N.C.

[21] Appl. No.: 71,093

[22] Filed: Jun. 4, 1993

[51] Int. Cl.[5] ..... E04B 2/76; E04C 3/32

[52] U.S. Cl. ..... 52/282.1; 52/281; 52/241; 52/729

[58] Field of Search ..... 52/349–354, 52/238.1, 241, 239, 481, 730.6, 731.7, 729, 243, 780, 781, 282.1, 281, 729, 241

[56] References Cited

U.S. PATENT DOCUMENTS

| | | | |
|---|---|---|---|
| 694,720 | 3/1902 | Brandstedt | 52/353 |
| 694,721 | 3/1902 | Brandstedt | 52/243 |
| 1,296,936 | 3/1919 | Jester | 52/241 |
| 1,458,652 | 6/1923 | Gooding | 52/354 |
| 2,141,919 | 12/1938 | Kotrbaty | 52/729 |
| 2,157,233 | 5/1939 | Geib, Jr. . | |
| 3,134,468 | 5/1964 | Toti et al. | 52/481 |
| 3,943,680 | 3/1976 | Balinski | 52/481 |
| 4,461,134 | 7/1984 | Lowe | 52/731.7 |

*Primary Examiner*—James L. Ridgill, Jr.

*Attorney, Agent, or Firm*—Marshall, O'Toole, Gerstein, Murray & Borun

[57] ABSTRACT

An area separation wall having modified H-studs with a web which includes a center portion perpendicular to the modified H-stud flanges and two side portions which are adjoined to the flanges at an angle of about 60°. Gypsum core boards with beveled edges are inserted into the two opposed channels of the modified H-studs with the edges of some of the core boards conforming to and abutting the side portions of the modified H-studs.

22 Claims, 2 Drawing Sheets

AREA SEPARATION WALL AND STUD THEREFOR

This invention relates to a novel area separation wall and to a novel stud for use therein.

Area separation walls are walls which are constructed in between adjoining homes, such as town houses and condominiums, where two homes share a common wall therebetween.

Area separation walls are commonly constructed of fixed vertical H-studs with two square-edged gypsum core boards mounted between each pair of two spaced-apart adjacent H-studs. The H-studs consist of a flat central web and flat flanges, joined perpendicularly to each edge of the web, at the center of each flange. The web is two inches wide and the square-edged core boards are each one-inch thick, substantially filling the two oppositely directed channels which the H-stud forms, two core board edges in each channel.

Each living unit, one on each side of the area separation wall, has rooms adjoining the area separation wall, and these rooms each have studs which are spaced from the area separation wall, with wallboard on only one side of these studs, forming the walls of these rooms.

A lower cost area separation wall is desirable, particularly one which performs equally well or better.

SUMMARY OF THE INVENTION

The present invention consists essentially of a modified H-stud used in combination with beveled edge core boards.

The modified H-studs have a web, which, instead of being flat, has a cross section which conforms to the edges of two beveled edge core boards which are inserted into the stud channel with core boards back-to-back. This modified H-stud can thus be made using 7% less metal while retaining the flange width and the flange-to-flange dimension.

It is an object of the invention to provide a lower cost area separation wall stud without sacrificing quality, size or performance.

It is a still further object to provide a novel area separation wall embodying a lower cost stud.

These and other objects and advantages of the invention will be more fully apparent when considered in relation to the preferred embodiments thereof as set forth in the specification and as shown in the drawings in which.

DESCRIPTION OF THE PREFERRED EMBODIMENTS

Figure 1:
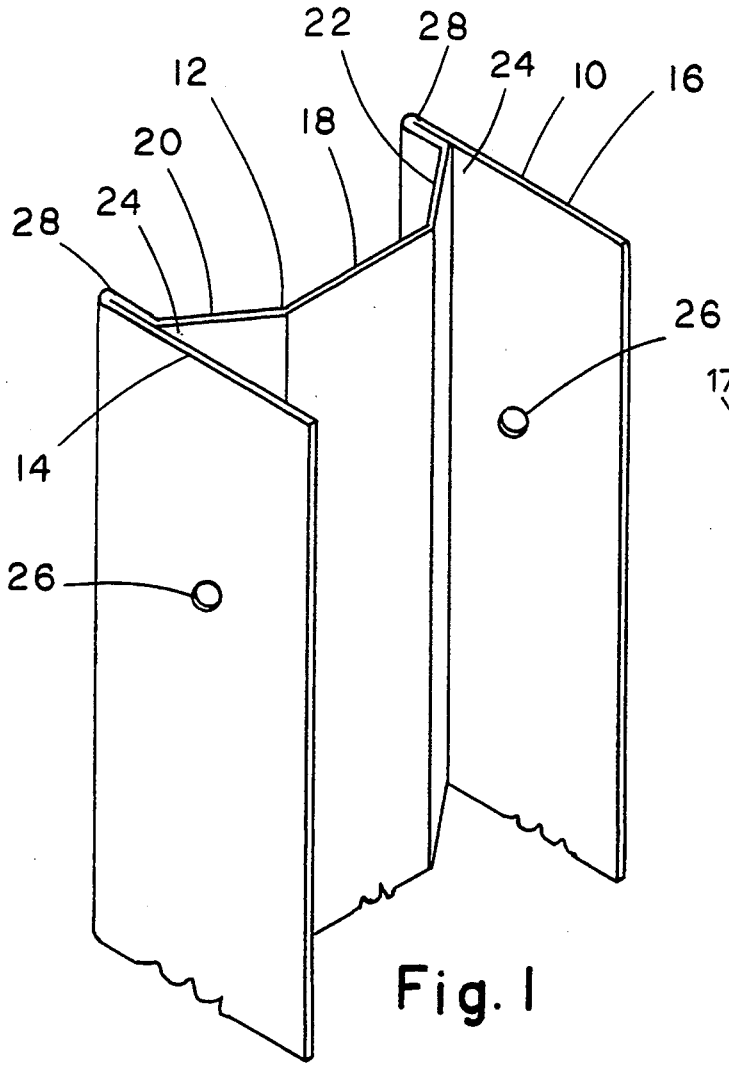
FIG. 1 is an isometric view of a novel modified H-stud for area separation walls.

Referring to FIG. 1, there is shown a modified H-stud 10, having a web 12 and two parallel, opposed flanges 14, 16. Web 12 includes center portion 18, which is perpendicular to flanges 14, 16, and two side portions 20, 22, each of which extends from center portion 18 to a flange 14 or 16, intersecting flanges 14, 16 at an acute angle 24, preferably about 60°. Side portions 20, 22 both extend angularly away from center portion 18 on the same side of center portion 18. With specific reference to FIG. 2, each of the flanges 14 and 16 has opposite edges 17 and 17*a*, and the enter portion 18 extends in a plane which intersects each of the flanges between the edges 17 and 17*a*. In the present instance, the plane intersects each of the flanges substantially midway between the edges 17 and 17*a*. Further, each of the side portions 20 and 22 adjoins an adjacent flange at a location which is between the above-mentioned plane and one of the edges 17 and 17*a*.

Flanges 14 and 16 are spaced two inches apart. Web center portion 18 is one-inch wide and side portions 20, 22 are each about 9/16-inch wide. Flanges 14, 16 each have a plurality of spaced-apart vent holes 26 along the center of flanges 14, 16. Flanges 14, 16 each include a narrow double-thickness portion 28 along one side of each flange 14, 16. Flanges 14, 16 are each about 1 5/16-inch wide.

Figure 2:
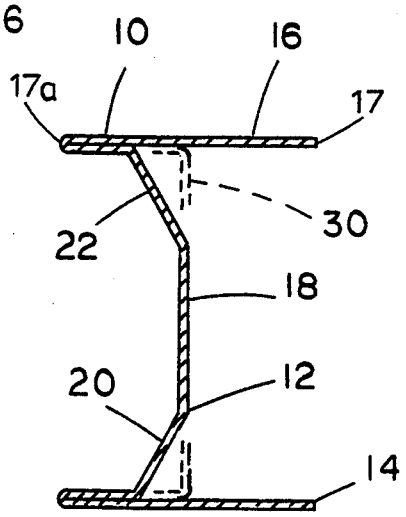
FIG. 2 is an end view, showing a cross section of the modified H-stud of FIG. 1, and, in broken lines, the cross-sectional portion of a prior area separation wall H-stud which differs from the modified H-stud of the invention.

The shape of web 12 is such that about a 7/16-inch-wide section of metal is saved, per stud, as compared to a prior area separation wall H-stud, as shown by the broken line section 30 of FIG. 2. This amounts to a 7% saving in metal usage.

Figure 3:
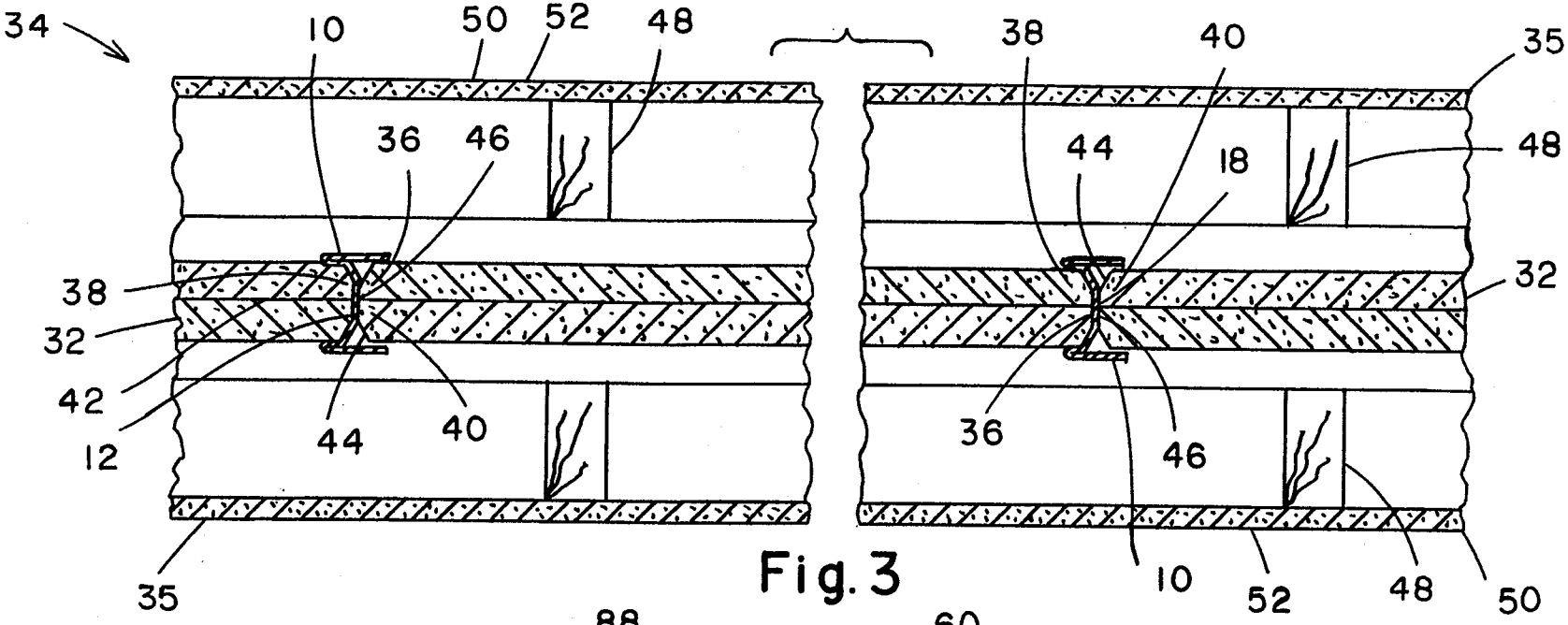
FIG. 3 is a cross-sectional plan view of the novel area separation wall, disposed between two exterior condominium walls.

In FIG. 3, the modified H-stud 10 is used with beveled edge core boards 32 in constructing an area separation wall 34, between two outside walls 35 of two adjacent town houses or condominiums. Wall 34 includes a plurality of spaced, vertical studs 10, with two beveled edge ore boards 32 disposed between each pair of adjacent studs 10, with the side edges 36 of each core board 32 extending into the opposed channels 38, 40 of each stud 10. The two core boards 32 between each pair of studs 10 are mounted, back face 42 to back face 42, and with the beveled portion 44 of each core board 32 facing outward.

Thus, in the channel 38 on one side of each stud 10, the core board edges 36 conform very closely with the shape of the web 12. In the channel 40, on the opposite side of each stud 10, the core board edges 36 have a non-beveled portion 46 which abut the web center portion 18.

Outside walls 35 each include a plurality of vertical studs 48 with wallboard 50 affixed thereto, forming the wall surfaces 52 of two adjacent town houses or condominiums. The studs 48 are all spaced away from the studs 10 and the core board 32, in accordance with accepted area separation wall construction.

Figure 4:
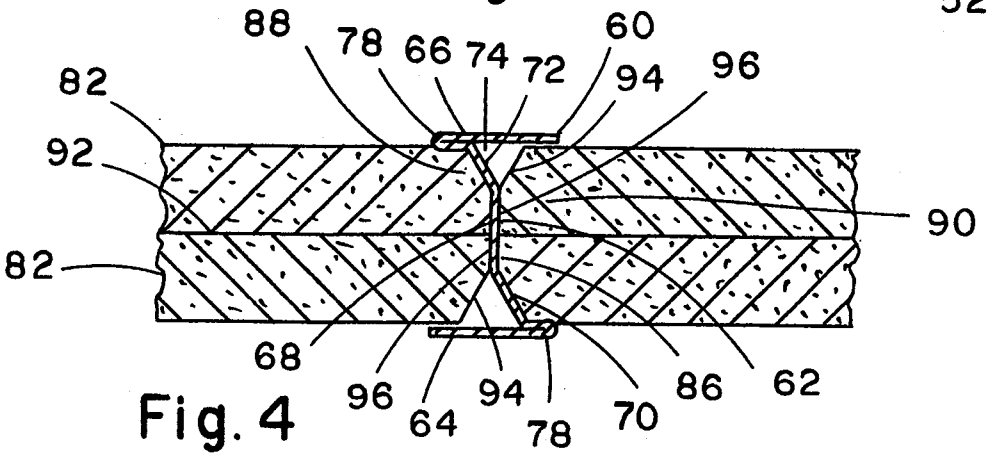
FIG. 4 is a cross-sectional plan view of a modified area separation wall.

FIG. 4 shows a different form of modified H-stud 60, which has a web 62 and two parallel, opposed flanges 64, 66. Web 62 includes center portion 68, which is perpendicular to flanges 64, 66, and two side portions 70, 72, each of which extends from center portion 68 to a flange 64 or 66, intersecting flanges 64, 66 at an acute angle 74, preferably about 60°. Whereas side portions 20, 22 of stud 10 are both on one side of center portion 18, the side portions 70, 72 of stud 60 will be seen to be on opposite sides of center portion 68.

Flanges 64, 66 are spaced two inches apart. Web center portion in one-inch wide and side portions 70, 72 are each about 9/16-inch wide. Flanges 64 66 each include a narrow double-thickness portion 78 along one side of each flange 64, 66. Flanges 64, 66 are each about 1 5/16-inch wide. Modified H-stud 60 also provides about a 7% savings in metal, compared to prior area separation wall H-studs.

The modified H-stud 60 is used with beveled edge core boards 82 in constructing an area separation wall. The studs 60 have two beveled edge core. boards 82 disposed between each pair of adjacent studs 60 with the side edges 86 of each core board 82 extending into the opposed channels 88, 90 of each stud 60. The two core boards 82 between each pair of studs 60 are mounted, back face 92 to back face 92, and with the beveled portion 94 of each core board 82 facing outward.

Thus, in the channel 88 on one side of each stud 60, the core board edges 86 of one core board 82 conforms very closely with the shape of the web 62 and on the other side of each stud 60, the core board edge 86 of one core board 82 conforms very closely with the shape of the web 62. A non-beveled portion 96 of the other two core boards 82 abut the web center portion 68.

Figure 5:
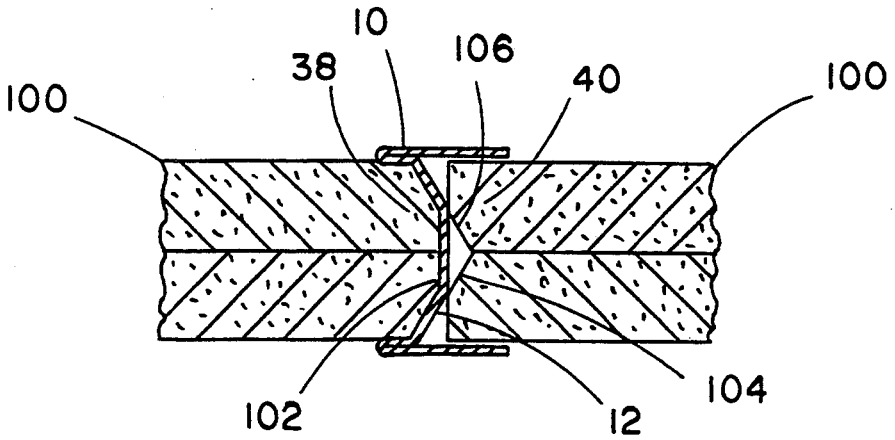
FIG. 5 is a cross-sectional plan view of a still further modified area separation wall.

FIG. 5 shows how modified H-stud 10 could be used with core boards 100, wherein the core boards 100 have side edges 102 on one side of the stud 10 which conform with the shape of web 12, and side edges 104 on the other side of stud 10 which have beveled portions 106 facing inwardly. This could be accomplished using core boards which have the beveled portions 106 which are on opposite edges of each core board on opposite faces of each core board, or by having the beveled portions 106 on both edges on the same face, but reversing the direction of channels 38, 40 on all adjacent studs 10.

Having completed a detailed disclosure of the preferred embodiments of my invention so that those skilled in the art may practice the same, I contemplate that variations may be made without departing from the essence of the invention or the scope of the appended claims.

I claim:

1. An H-stud for an area separation wall comprising an elongate formed sheet metal web and a pair of parallel, spaced apart, elongate, formed sheet metal flanges, said web connecting said flanges and having a center portion and two side portions, said center portion being in a plane which is perpendicular to said flanges, and said side portions extending angularly from said center portion to said respective flanges and being adjoined to said respective flanges, each of said flanges having opposite edges, said plane intersecting each of said flanges at a location which is between said opposite edges, and each of said side portions being adjoined to one of said flanges at an acute angle and at a location which is between said plane and one of said opposite edges.

2. An H-stud as defined in claim 1, wherein said acute angle is about 60°.

3. An H-stud as defined in claim 1, wherein said web center portion is about one-inch wide and said web side portions are about 9/16-inch wide.

4. An H-stud as defined in claim 1, wherein said flanges include a double-thickness portion adjacent one of said edges.

5. An H-stud as defined in claim 1, wherein said web and said flanges form a pair of channels which open in opposite directions, each of said channels having a width equal to the distance between said spaced apart flanges, said channels being operable to receive boards of said area separation wall and said width of said channels being substantially equal to the thickness of said boards.

6. An H-stud as defined in claim 1, wherein said side portions are both on a same side of said plane of said center portion.

7. An H-stud as defined in claim 6, wherein said acute angle is about 60°.

8. An H-stud as defined in claim 1, wherein said two side portions are on opposite sides of said plane of said center portion.

9. An H-stud as defined in claim 8, wherein said acute angle is about 60°.

10. An area separation wall comprising a plurality of spaced, aligned H-studs and a plurality of boards interposed between said H-studs, each of said H-studs having a web adjoining a pair of spaced parallel flanges, said web connecting said flanges and having a center portion extending in a plane which is perpendicular to said flanges and two side portions each extending from said center portion to one of said flanges, said side portions adjoining said flanges at an acute angle, each of said flanges having opposite edges, said plane intersecting each of said flanges at a location which is between said opposite edges, each of said side portions being adjoined to one of said flanges at a location which is between said plane and one of said opposite edges, said web and said flanges forming a pair of opposed channels, and said boards having side edges disposed within said channels.

11. An area separation wall as defined in claim 10, wherein said flanges have a plurality of vent holes in said flanges.

12. An area separation wall as defined in claim 10, wherein said flanges include a double-thickness portion along one side of each said flange.

13. An area separation wall as defined in claim 10, wherein said boards are gypsum core boards.

14. An area separation wall as defined in claim 10, further comprising a plurality of vertical wall studs aligned closely adjacent but spaced from said H-studs and said boards on each side thereof, and a plurality of wallboards affixed to said wall studs on a side of said wall stud remote from said H-studs and said boards.

15. An area separation wall as defined in claim 14, wherein said boards have beveled edges with bevels substantially equal to said acute angle of said web side portions and substantially equal in width to a width of said web side portions, with some of said beveled edges conforming to the shape of abutting portions of said web.

16. An area separation wall as defined in claim 10, wherein said boards have beveled edges with bevels substantially equal to said acute angle of said web side portions and substantially equal in width to a width of said web side portions, with some of said beveled edges conforming to the shape of abutting portions of said web.

17. An area separation wall as defined in claim 16, wherein said acute angle is about 60°.

18. An area separation wall as defined in claim 16, wherein said channels are about two inches wide and said web center portion is about one-inch wide, and wherein two said boards are each about one-inch thick and have beveled side edges disposed in each said channel.

19. An area separation wall as defined in claim 18, wherein said web side portions of each said stud are on a same side of said center portion of each said stud, and said two beveled edge core boards on said same side each have a bevel conforming to and abutting said side portions.

20. An area separation wall as defined in claim 19, wherein said acute angle is about 60°.

21. An area separation wall as defined in claim 18, wherein said web portions of each said stud are on an opposite side of said center portion of each said stud, and said two beveled edge boards abutting said side portions conform to said acute angle of said side portions.

22. An area separation wall as defined in claim 21, wherein said acute angle is about 60°.

* * * * *